US005216324A

United States Patent [19]

Curtin

[11] Patent Number: 5,216,324

[45] Date of Patent: Jun. 1, 1993

[54] MATRIX-ADDRESSED FLAT PANEL DISPLAY HAVING A TRANSPARENT BASE PLATE

[75] Inventor: Christopher J. Curtin, Portland, Oreg.

[73] Assignee: Coloray Display Corporation, Fremont, Calif.

[21] Appl. No.: 545,988

[22] Filed: Jun. 28, 1990

[51] Int. Cl.[5] ..... H01J 1/62

[52] U.S. Cl. ..... 313/495; 313/497; 313/422; 313/309; 340/752; 340/781

[58] Field of Search ..... 313/495, 496, 497, 422, 313/309, 336, 495, 495, 497; 340/773, 771, 772, 784, 752, 717, 784 H, 781

[56] References Cited

U.S. PATENT DOCUMENTS

| | | | |
|---|---|---|---|
| 4,081,716 | 3/1978 | Uemura | 313/497 X |
| 4,472,658 | 9/1984 | Morimoto et al. | 313/497 |
| 4,563,613 | 1/1986 | Gemorese et al. | 313/497 |
| 4,666,548 | 5/1987 | Eto et al. | 313/497 X |
| 4,857,799 | 8/1989 | Spindt et al. | 313/496 X |

FOREIGN PATENT DOCUMENTS

| | | | |
|---|---|---|---|
| 2097238 | 5/1987 | Japan | 313/497 |

*Primary Examiner*—Donald J. Yusko
*Assistant Examiner*—Ashok Patel
*Attorney, Agent, or Firm*—Flehr, Hohbach, Test, Albritton & Herbert

[57] ABSTRACT

A matrix-addressed flat panel display is disclosed herein and includes a face structure having a phosphor coated viewing surface and a transparent backing structure spaced a predetermined distance from and in confronting relationship with the viewing surface of the face structure. The display also includes a matrix array of individual electron generating elements positioned between the backing structure and the face structure and address means for energizing selected ones of the electron generating elements so as to establish a desired light pattern on the viewing surface of the face structure. This matrix array and address means are configured such that the desired light pattern is readily viewable through the backing structure, matrix array and address means.

9 Claims, 1 Drawing Sheet

MATRIX-ADDRESSED FLAT PANEL DISPLAY HAVING A TRANSPARENT BASE PLATE

BRIEF DESCRIPTION OF THE INVENTION

The present invention relates generally to flat panel displays and, more particularly, to a low energy matrix-addressed flat panel display utilizing field emission cathodes.

BACKGROUND OF THE INVENTION

A representative matrix-addressed flat panel display in the prior art is described in U.S. Pat. No. 4,857,799 which is incorporated herein by reference. The display described there includes a transparent face plate or structure mounted over and spaced from a backing plate or structure so as to define an interior chamber. The transparent face plate carries on its internal surface a thin coating or film of electrically conductive transparent material, such as indium tin oxide, which serves as an accelerator plate. Individual phosphor-coated stripes or dots are provided over this latter film. The internal surface of the backing plate supports a matrix array of field emission cathodes in confronting relationship with the face plate and suitable address means for energizing selected ones of the field emission cathodes, thereby causing the energized cathodes to bombard the phosphor-coated stripes on the face plate with electrons which, in turn, results in the emission of visible light. It is this light that is viewed by the observer through the face plate of the flat panel display.

While the matrix-addressed flat panel display disclosed in U.S. Pat. No. 4,857,799 is generally satisfactory for its intended purpose, there are relatively large light losses due to the radiation toward the baseplate. Specifically, as is evident in U.S. Pat. No. 4,857,799 , some of the light is lost through the phosphor stripes and all of the light directed toward the backing plate is lost to the observer. As a result, in order to provide sufficient light to the observer, the field emission cathodes must be driven at relatively high voltages so as to provide sufficiently high energy electron beams.

As will be seen hereinafter, the present invention eliminates the draw back described immediately above by providing a matrix-addressed flat panel display which is viewed, by the observer through a transparent backing plate rather than through the face plate. As a result, the electron bombarded side of the phosphor coating can be viewed directly and, as will be seen, some of the light emitted behind the phosphor coating can be redirected toward the observer. In that way, the field emission cathodes or other such light generating means can be driven at lower voltages than would be otherwise required for providing the desired level of viewing light.

It should be noted at the outset that there are other types of display devices which utilize transparent face plates for the purpose of viewing displays. One such device is a liquid crystal display (LCD) in which a liquid crystal material is disposed between what may be characterized as a face plate and what may be characterized as a base plate. The face plate either carries a mirrored surface or its own independent source of light. Both the base plate, which is transparent, and the face plate carry a matrix-array of electrically conductive leads which are selectively energized in a way that selectively polarizes the liquid crystal material in order to allow the viewer to selectively view segments or pixels of the face plate in order to provide the desired display. Obviously, those electrical leads must either be constructed of transparent material or, if opaque, they must be sufficiently thin to be virtually invisible. The present state of the art is capable of providing both types of electrically conductive leads.

A second type of device that utilizes what may be characterized as a transparent cover plate for viewing purposes is a vacuum fluorescent display (VFD). Such a device is typically found on, for example, a microwave oven or other such appliance. Its transparent cover plate is spaced from and in confronting relationship with a phosphor screen which has a series of positively pulsing eight-segment fluorescent characters. A hot filament cathode wire and a suitable grid are positioned between the phosphor support plate and transparent cover plate for providing a continuous supply of electrons which bombard selected segments of the eight-segment displays for illuminating the latter.

While the VFD device utilizes what may be characterized as a transparent cover plate and relies on electron bombardment to energize its eightsegment fluorescent displays, the device does not require matrix-addressing of individual cathodes or use the cover plate in the electronic operation of the device. Rather, a single hot filament cathode wire is sufficient to provide a continuous supply of electrons. As a result, there is no real concern for obstructing the view of the observer through the transparent cover plate. On the other hand, the LCD device described above does, indeed, utilize a matrix-array of electrically conductive leads located on one side of its liquid crystal material. However, the matrix-addressing of those leads is not associated with the selective energization of individual field emission cathodes. The LCD device merely acts as a series of selective light valves which turn on and off by means of the addressing arrangements.

SUMMARY OF THE INVENTION

Heretofore, the idea of providing a matrix-addressed flat panel display with a transparent base plate through which its display could be viewed was not considered, particularly in displays utilizing field emission cathode technology. First, an important advantage of matrix-addressed flat panel displays using field emission cathodes has been the elimination of the transparent base plate, thereby making it possible to use fairly wide metallic (nontransparent) electrical leads as part of the addressing arrangement for driving the cathodes. Because these leads are quite wide in the typical prior art matrix-addressed flat panel display, for example on the order of 4 mils, their resistance is lower than it would be if the leads were thinner. Indeed, heretofore it has been thought that the resistance of the matrix-address leads would be too high to adequately drive the field emission cathodes at the desired speed if the leads were made sufficiently thin to be hidden from view through a transparent base plate. Specifically, it was thought that the RC time constant of the addressing circuit would be too high.

It is a primary object of the present invention to provide a matrix-addressed flat panel display which does, indeed, utilize a transparent base plate through which its display is viewed.

A more particular object of the present invention is to provide a matrix-addressed flat panel display which includes a transparent base plate and matrixaddressed electron generating means, specifically, field emission cathodes, and specifically a display in which the generating means can be driven at relatively high speeds.

As will be described in detail hereinafter, the matrix-addressed flat panel display disclosed herein includes a face structure having a viewing surface and a transparent backing structure spaced a predetermined distance from and in confronting relationship with the viewing surface of the face structure. A matrix array of individual electron generating means is positioned between the backing structure and face structure along with address means for energizing selected ones of the electron generating means so as to establish a desired light pattern on the viewing surface. The matrix array and the address means are configured such that the desired light pattern is readily viewable from behind and through the backing structure, matrix array, and the address means.

The display disclosed herein will be described in more detail hereinafter in conjunction the drawings, wherein:

DESCRIPTION OF THE PREFERRED EMBODIMENT

Figure 1:
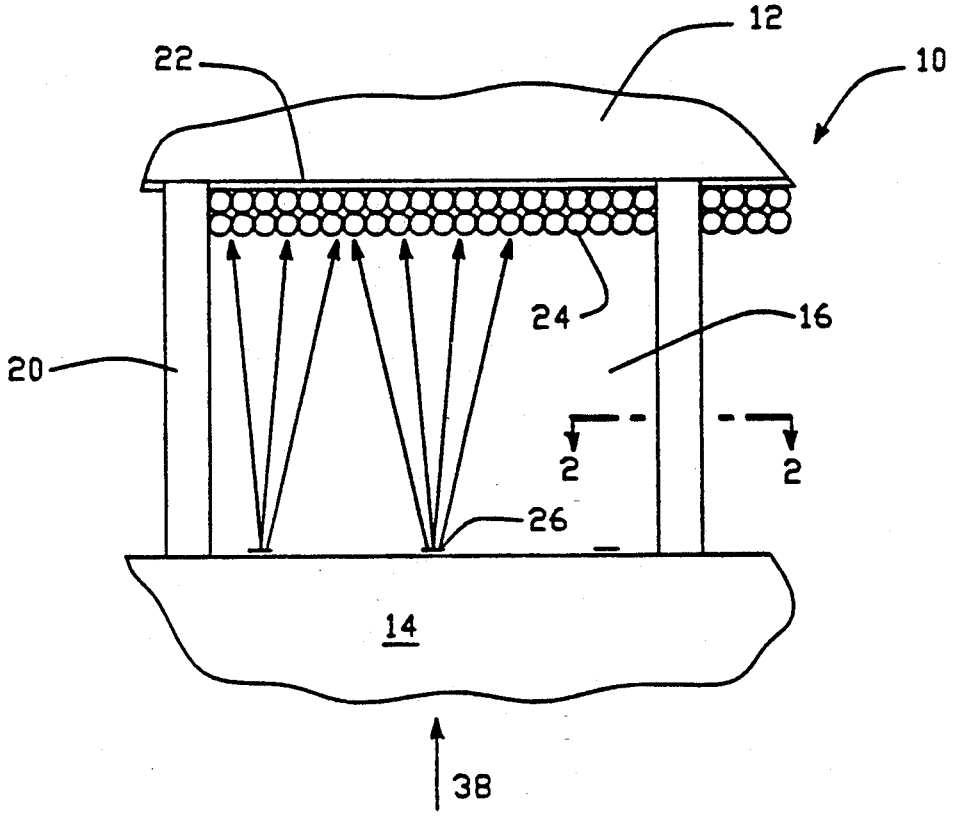
FIG. 1 is a sectional view of a matrix-addressed flat panel display designed in accordance with the present invention.

Turning now to the drawings, wherein like components are designated by like reference numerals, attention is first directed to FIG. 1. This figure illustrates a matrix-addressed flat panel display designed in accordance with the present invention and generally indicated by the reference numeral 10. Display 10 includes a face plate or structure 12 and a backing plate or structure 14 spaced a predetermined distance from and in confronting relationship with face plate 12 so as to define an internal chamber 16 therebetween. While not shown, the outer peripheral edge of the overall display is closed to vacuum seal interior chamber 16. Pillars 20 to be described in more detail hereinafter extend between the face plate and backing plate and serve both as a reinforcement of the overall display and as spacers between the two plates.

As illustrated in FIG. 1, the interior side of face plate 12 includes a thin coating or film 22 of an electrically conductive material which serves as an accelerator plate. For the reasons to be discussed, in a preferred embodiment, this layer is formed of aluminum or other such suitable electrically conductive material which also can function as a light reflecting mirror. Mounted on top of the layer 22 is a phosphor-coating 24 which can be a continuous layer, as illustrated, or separate and distinct stripes or dots, as in the U.S. Pat. No. 4,857,799 patent.

Figure 2:
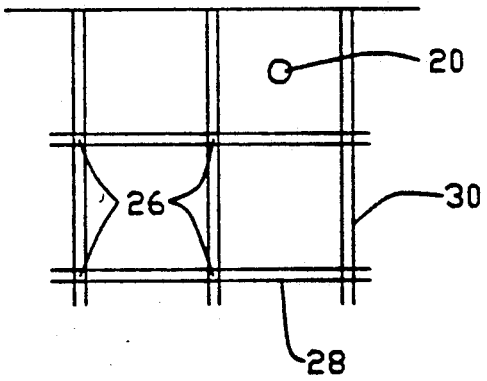
FIG. 2 is a sectional view of the display of FIG. 1, taken generally along line 2—2 in FIG. 1.
Figure 4:
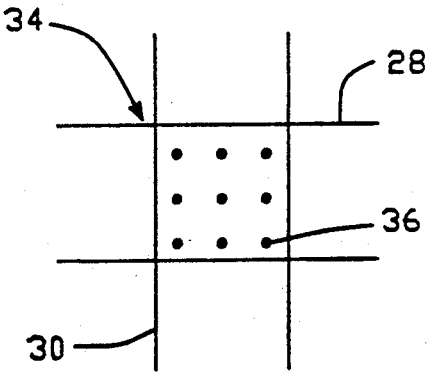
FIG. 4 is an enlarged top plan view of a segment of the section illustrated in FIG. 3.
Figure 3:
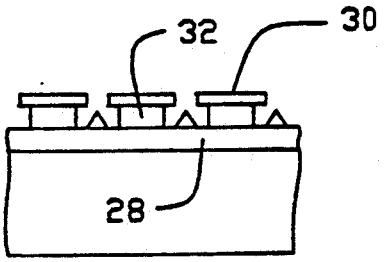
FIG. 3 is an enlarged sectional view of the device of FIG. 1, particularly illustrating its array of field emission cathodes.

Base plate 14 supports a matrix-array of individual addressable electron generating means, specifically, field emission cathodes 26, as best illustrated in FIG. 3. The base plate also supports a matrix-array of electrically conductive leads which form part of an overall address arrangement for energizing selected ones of the electron generating field emission cathodes 26 so as to establish a desired light pattern across the phosphor-coating 24, as will be discussed below. Two such leads are illustrated in particular in FIG. 4 and generally indicated by the reference numerals 28 and 30. Note that lead 28 is one of a series of horizontal or row leads mounted directly onto base 14, which, as will be seen, is constructed of a dielectric material. The lead 30 which is normal to lead 28 is one of a series of vertical or column leads supported above leads 28 by means of a dielectric layer 32. The way in which these leads form a row/column matrix array is diagrammatically illustrated in FIG. 2. As illustrated in FIG. 4, any given horizontal lead 28 crosses a given vertical lead 30 at a juncture 34. At each juncture 34, one or more openings 36 extend through the top lead 30 and dielectric layer 32 so as to expose a segment of the lower lead 28. One field emission cathode 26 is formed on that exposed segment within the boundaries of each opening 36. In the example illustrated in FIG. 4, a plurality of field emission cathodes are illustrated.

As described thus far, overall matrix-addressed flat panel display 10 functions in the same general manner as the matrix addressed flat panel display described in U.S. Pat. No. 4,857,799. That is, suitable power/switching means (not shown), in combination with the matrix array of electrically conductive leads 28 and 30, energize selected ones of the field emission cathodes at any given point in time so as to cause the cathodes energized to emit free electrons. Those electrons are caused to bombard corresponding pixels on the phosphor-coating 24 in order to cause the latter to light up. In the case of the flat panel display illustrated in U.S. Pat. No. 4,857,799, the light generated at each pixel is viewed through the face plate, which is transparent, as indicated previously. In the case of the matrix-addressed flat panel display 10, base plate 14 and dielectric layer 32 are transparent and viewing takes place behind the base plate, as indicated by arrow 38. In a preferred embodiment, the dielectric layer 32 is constructed of transparent silicon dioxide. Base plate 14 is constructed of an inexpensive glass with suitable mechanical and chemical properties.

In order to view the phosphor-screen 24 through transparent base plate 14, the matrix array of electrically conductive leads 34 must either be very thin, if they are constructed of metal, or they must be constructed of a transparent electrically conductive material, for example indium tin oxide. Both are contemplated by the present invention. However, in a preferred embodiment, the leads are constructed of opaque metal and they are made sufficiently thin so as to allow the observer to readily view the phosphor-screen. In a preferred embodiment, these leads are approximately 0.5 mils wide and like leads (either column or row leads) are spaced 6 mils apart, and approximately 80% of the phosphor screen 24 is visible from behind the base plate 14.

In order to operate flat panel display 10 in the desired manner, each row is scanned, one at a time, and it must be scanned at a rapid rate, for example, at a rate of 60,000–150,000 (rows) per second. However, by making the leads 28 and 30 sufficiently thin so as to be almost invisible, as in display 10, the resistance increases linearly with decreases in line width. This, in turn, increases the RC time constant linearly, thereby slowing down the speed at which the field emission cathodes can be energized and de-energized. For this reason, the flat panel display disclosed in the U.S. Pat. No. 4,857,799 patent has been most desirable in the past. The matrix of electrically conductive leads in this latter device can be made wide (since they are not being viewed through) and , hence, the resistance associated with these leads is relatively small. However, what this approach does not consider is the contribution to the RC time constant by the capacitance between the horizontal and vertical leads at the points they cross one another, that is, at the junctures surrounding openings 36, one of which is illustrated in FIG. 4. In fact, as will be discussed immediately below, by thinning out the lead lines, even though the resistance increases, thereby increasing the RC time constants, the capacitance associated with the same time constants is reduced by a greater amount, thereby decreasing the overall time constant.

Referring specifically to FIG. 4, there is a time constant associated with each row and column intersection, in the surrounding area defining junction 34. The RC time constant at any given juncture is the product of the resistance of the leads and the capacitance between the crossing leads in that area. As stated previously, the resistance is linearly dependent upon the width of the lead lines. However, it is also proportional to the area defined by juncture 34. Since that area is the square of the width of each lead (for equal width leads), the capacitance is a square function of the width of each lead. Therefore, if, for example, the width of each lead 28 and 30 is reduced by ½, the area decreases by ¼, while the resistance increases ½, thereby reducing the RC time constant by ½. In other words, applicants have found that decreasing the width of the leads does not increase the time constant but rather decreases it. In a prior art type matrix-addressed flat panel display such as the one disclosed in U.S. Pat. No. 4,857,799, the width of these leads are typically 4 mils. In a preferred embodiment of display 10, each of the leads is 0.5 mil. This means that the capacitance in the former case is 64 times the capacitance in the latter case. At the same time, the resistance in the latter case is 8 times the resistance in the former case. Thus, the overall RC time constant is approximately 8 times lower with the thinner leads.

As a result of the narrower leads 30, much more of the top surface of dielectric substrate 32 is exposed. In fact, in a preferred embodiment, approximately 75% of that surface is exposed. As a result, the pillars 20 can be formed directly on the internal surface of dielectric base plate 14 between adjacent leads 28 without ever touching the leads. As a result, these pillars can be constructed of metal without fear of creating shorts between adjacent leads. This is to be contrasted with, for example, the flat panel display device described in U.S. Pat. No. 4,857,799. There, the pillars, if used, have to be constructed of a dielectric material since there is not enough exposed space on its base. An important feature of the overall matrixaddressed flat panel display 10 resides in the fact that its phosphor-screen 24 is viewed through the transparent base plate 14. This means that the actual light emitted off of this screen is viewed directly off the phosphor, not though the screen. At the same time, as indicated previously, the accelerator plate 22 can also serve as a mirrored surface, thereby reflecting rearwardly directed light back toward the observer. Thus, the light intensity, as viewed by the observer is greater than it would be if the same light pattern were viewed from behind the base plate, as in the display in U.S. Pat. No. 4,857,799. In fact, a gain in viewing brightness of approximately 2.5 times can be expected. This combined with a 20% loss due to the opaqueness of leads 28 and 30 results in a combined increase in brightness of approximately two times greater than it would be if the phosphor screen were viewed through the face plate. As a result, display 10 is especially suitable for use at low operating voltages where the electrons cannot penetrate a conventionally aluminized layer. Specifically, in a preferred embodiment, the display is operated so as to produce 500 volt electrons. This allows easily fabricated spacers to be used. Because the low voltage bombarding electrons impact mostly on the surface phosphor rather than deep inside the layer, therefore, more of the light is made visible to the observer.

What is claimed is:

1. A flat panel display, comprising:

(a) a face structure having a viewing surface;

(b) a transparent backing structure spaced a predetermined distance from and in confronting relationship with the viewing surface of said face structure;

(c) a matrix array of individually addressable electron generating means positioned on said backing structure, between the latter and said face structure, and address means for energizing selected ones of said electron generating means so as to establish a desired light pattern on said viewing surface, said matrix array and said address means being configured such that the desired light pattern is readily viewable through said backing structure, said matrix array, and said address means; and (d) an accelerator plate structure positioned on the interior side of said face structure for attracting electrons and including luminescing means for reflecting some of said light pattern back toward said viewing surface.

2. A flat panel display according to claim 1 wherein said matrix array of individually addressable electron generating means comprises a matrix array of addressable cathodes positioned between said backing structure and said face structure, wherein said accelerator plate structure is made of an electrically conductive mirrored substrate, and wherein said luminescing means reacts to bombardment by electrons emanating from said cathodes by emitting visible light.

3. A flat panel according to claim 2 wherein said address means includes a matrix array of electrically conductive leads located across said transparent backing structure.

4. A flat panel display according to claim 3 wherein said leads are constructed of thin opaque metal strips.

5. A flat panel display according to claim 3 wherein said leads are constructed of transparent strips.

6. A flat panel display according to claim 3 wherein said backing structure is constructed of a dielectric material and wherein said leads forming said matrix array of electrically conductive leads are sufficiently thin to expose areas which are on said dielectric backing structure and which confront said face structure, said display including a plurality of metal pillars normal to and extending between said exposed areas on said face structure and serving as spacers between said structures.

7. A flat panel display according to claim 6 wherein said exposed areas comprise approximately 75% of said transparent backing.

8. A flat panel display according to claim 7 wherein said electrically conductive leads are constructed of metal and are individually approximately 0.5 mil wide.

9. A flat panel display according to claim 1 wherein said accelerator plate structure includes an electrically conductive mirrored substrate directly behind said luminescing means and serving as a means of reflecting some of said visible light and as an accelerator plate for said electrons.

* * * * *